US010109953B2

(12) United States Patent
Schmidt

(10) Patent No.: US 10,109,953 B2
(45) Date of Patent: Oct. 23, 2018

(54) ELECTRICAL CONNECTOR SYSTEM COMPRISING A SECONDARY LOCKING DEVICE

(71) Applicant: Delphi International Operations Luxembourg, S.A.R.L., Bascharage (LU)

(72) Inventor: Rainer Q Schmidt, Nuremberg (DE)

(73) Assignee: Delphi International Operations Luxembourg S.A.R.L (LU)

( * ) Notice: Subject to any disclaimer, the term of this patent is extended or adjusted under 35 U.S.C. 154(b) by 0 days.

(21) Appl. No.: 15/565,308

(22) PCT Filed: Apr. 25, 2016

(86) PCT No.: PCT/EP2016/059140
§ 371 (c)(1),
(2) Date: Oct. 9, 2017

(87) PCT Pub. No.: WO2016/173971
PCT Pub. Date: Nov. 3, 2016

(65) Prior Publication Data

US 2018/0062314 A1 Mar. 1, 2018

(30) Foreign Application Priority Data

Apr. 29, 2015 (EP) ..... 15165730

(51) Int. Cl.
*H01R 13/639* (2006.01)
*H01R 13/627* (2006.01)

(52) U.S. Cl.
CPC ..... *H01R 13/639* (2013.01); *H01R 13/6272* (2013.01)

(58) Field of Classification Search
CPC ..... H01R 13/639; H01R 25/162; H01R 13/6658; H01R 13/6275; H01R 13/6599;
(Continued)

(56) References Cited

U.S. PATENT DOCUMENTS 5,591,041 A * 1/1997 Cecil, Jr. ..... H01R 13/506 439/352
5,967,859 A * 10/1999 Cecil, Jr. ..... H01R 13/4368 439/595

(Continued)

FOREIGN PATENT DOCUMENTS

EP 2 211 427 A2 7/2010

*Primary Examiner* — Truc Nguyen
(74) *Attorney, Agent, or Firm* — Robert J. Myers

(57) ABSTRACT

The invention relates to an electrical connector system comprising a plug connector and a second locking device. The plug connector comprises at least one row of terminal cavities for receiving terminals and a plug connector housing having a flexible arm arranged in a sidewall of the plug connector housing, and having primary locking means adapted to provide a primary locking function. The secondary locking device is arranged between an end of the at least one row of terminal cavities and the flexible arm, and has a flexible leg with secondary locking means for providing a secondary locking function. The flexible arm comprises a blocking device and the flexible leg comprises an abutment device adapted to engage with the blocking device for said blocking.

23 Claims, 12 Drawing Sheets

(58) Field of Classification Search
CPC ..... H01R 2103/00; H01R 2201/26; H01R 24/62; H01R 24/64; H01R 25/006; H01R 12/714; H01R 13/504; H01R 13/506; H01R 13/514
See application file for complete search history.

(56) References Cited

U.S. PATENT DOCUMENTS 6,045,388 A * 4/2000 Higgins ..... H01R 13/6273 439/352
6,186,805 B1 * 2/2001 Krishnaswamy .. H01R 13/7032 200/51.1
6,312,277 B1 * 11/2001 Holub ..... H01R 13/6272 439/352
6,341,984 B1 * 1/2002 Murakami ..... H01R 13/5208 439/587
6,435,895 B1 * 8/2002 Fink ..... H01R 13/6272 439/352
6,468,105 B2 10/2002 Noguchi et al.
7,326,074 B1 * 2/2008 Lim ..... H01R 13/629 439/352
7,955,142 B1 * 6/2011 Shuey ..... H01R 13/506 439/752
2006/0223355 A1 * 10/2006 Hirschmann ..... H01R 13/6273 439/352
2007/0155254 A1 * 7/2007 Daudin ..... H01R 13/4361 439/752
2009/0247011 A1 * 10/2009 Myer ..... H01R 13/4223 439/595
2014/0004732 A1 1/2014 Heil et al.
2014/0295685 A1 10/2014 Wimmer
2015/0079827 A1 * 3/2015 Hara ..... H01R 13/05 439/188

* cited by examiner

ELECTRICAL CONNECTOR SYSTEM COMPRISING A SECONDARY LOCKING DEVICE

CROSS-REFERENCE TO RELATED APPLICATIONS

This application is a national stage application under 35 U.S.C. § 371 of PCT Application Number PCT/EP2016/059140 having an international filing date of Apr. 25, 2016, which designated the United States, said PCT application claiming the benefit of European Patent Application No. 15165730.1, filed Apr. 25, 2016, the entire disclosure of each of which are hereby incorporated herein by reference.

TECHNICAL FIELD OF THE INVENTION

The present invention relates generally to a connector system comprising a plug connector and a secondary locking device.

BACKGROUND OF THE INVENTION

Electrical connector systems comprising a plug connector and a secondary locking device are known in the art. For example, plug connectors having a plug connector housing comprising a row of terminal cavities are known for electrical connections in vehicles. Such electrical connectors are becoming smaller and smaller. However, there is a limit to miniaturize these connectors as they must remain robust, easy to manufacture and easy to handle.

The objective of this invention is to provide an electrical connector system that is robust, simple and easy to manufacture and/or at least provide an alternative.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

According to the invention, an electrical connector is provided which comprises a plug connector and a secondary locking device. The secondary locking device is also in the art known as a Connector Positioning Assurance (CPA). The plug connector comprises at least one row of terminal cavities for receiving terminals and a plug connector housing. The plug connector housing comprises a flexible arm arranged in a sidewall of the plug connector housing. The plug connector housing further comprises a primary locking protrusion configured to provide a primary locking function when the plug connector is in the mated position with a corresponding counter-connector. A secondary locking protrusion is configured to provide a secondary locking function when the plug connector is in the mated position with the corresponding counter-connector.

The secondary locking device is arranged between an end of the at least one row of terminal cavities and the flexible arm of the plug connector housing. The end of the at least one row terminal cavities is the end that faces the flexible arm, or in other words, the end that is closest to the flexible arm. The secondary locking device is further arranged movable relative to the plug connector housing between an un-lock and lock position. The lock position corresponds to a locked position wherein the secondary locking device provides the secondary locking of the plug connector to the counter-connector. The secondary locking device comprises a flexible leg with the secondary locking protrusion.

The flexible arm of the plug connector housing comprises a blocking device configured to block the secondary locking device from moving from the un-lock to the lock position when the plug connector is in an unmated position with the counter-connector.

The flexible leg of the secondary locking device comprises an abutment device configured to engage with the blocking device for the blocking.

Having the flexible arm in the sidewall of the plug connector housing, the secondary locking device in between the end of the row of terminal cavities, and the blocking device engaging with the abutment device is advantageous as it may allow a plug connector housing and counter-connector that is easier to mold, is more robust regarding a scoop proof function and the secondary locking function.

Having the flexible arm in the sidewall of the plug connector housing and the secondary locking device in between the end of the row of terminal cavities and the flexible arm allows an interaction, blocking or engagement between the blocking device and the abutment device while the primary locking function and secondary locking function with the counter-connector can be performed more compact. The primary and secondary locking protrusions are relatively near to each other and may preferably face outwards in a same direction.

In an embodiment of the connector system according to the invention, the primary and secondary locking protrusion each protrude outwards towards the counter-connector, wherein the primary and secondary locking protrusions are configured to cooperate with respectively a primary and a secondary opening in the counter-connector. The primary and the secondary opening are arranged in a same sidewall of the counter-connector. This has as advantage that it allows for a more compact and robust plug connector and counter-connector. Preferably, the counter-connector is free from protrusions for a primary and/or secondary locking function. Instead, the counter-connector comprises openings to receive the primary and/or secondary protrusions for the primary and/or secondary locking function.

In an embodiment of the connector system according to the invention, the secondary locking protrusion is arranged on an outwardly facing side of the flexible leg and the abutment device is arranged on an opposing inwardly facing side of the flexible leg. With outwardly facing is meant towards the counter-connector when the plug connector is at least partly received in the counter-connector. With inwardly facing is meant towards an interior of the plug connector when the secondary locking device is at least partly received in the plug connector. This is advantageous as using one flexible leg allows on the one hand the secondary locking function and on the other hand the blocking of the secondary locking device with respect to the plug connector.

In an embodiment of the connector system according to the invention, the blocking device is arranged on an inwardly facing side of the flexible arm. The primary locking protrusion is arranged on an opposing outwardly facing side of the flexible arm. Again, with inwardly facing is meant towards an interior of the plug connector. With outwardly facing is meant towards the counter-connector when the plug connector is at least partly received in the counter-connector. This is advantageous as using one flexible arm allows on the one hand the primary locking function and on the other hand the blocking of the plug connector with respect to the secondary locking device.

In a preferred embodiment, the abutment device as well as the blocking device is on a respective inwardly facing side. In order to have them engage each other to provide the blocking, the blocking device protrudes inwardly and sideward towards the flexible leg of the secondary locking device.

Alternatively, the abutment device protrudes inwardly and sideward towards the flexible arm of the plug connector housing.

In a further alternative, both the abutment device and the blocking device are protruding sideward towards each other, such that they are able to engage each other for the blocking.

In an embodiment of the connector system according to the invention, the plug connector housing comprises an elongated first slot along the mating direction (A). The mating direction corresponds to the direction of the plug connector when it is moved from the unmated to the mated position with the counter-connector. The elongated first slot is arranged in a sidewall of the plug connector housing. The secondary locking protrusion is configured to protrude outwardly through the elongated first slot. This allows the secondary locking protrusion to engage or cooperate with a secondary opening arranged in a side wall of the counter-connector, while the primary locking protrusion is able to engage or cooperate with a primary opening arranged in the same side wall. This allows a compact and robust solution for the primary and secondary locking function.

In a further embodiment, the elongated first slot is arranged adjacent to the flexible arm of the plug connector housing. The elongated first slot contributes to the flexibility of the flexible arm. In other words, the elongated first slot defines one longitudinal edge of the flexible arm.

In an even further embodiment, the plug connector housing comprises an elongated second slot along the mating direction. This elongated second slot is arranged adjacent to the flexible arm and contributes to the flexibility of the flexible arm. In other words, the elongated second slot defines another longitudinal edge of the flexible arm. Therefore, the flexible arm is arranged between the elongated first and second slot.

In an embodiment of the connector system according to the invention, the flexible arm extends from its first end to its free end in a direction opposite to the mating direction. In other words, the flexible arm extends from a connection end of the plug connector housing in a direction opposite to the mating direction. The connection end of the plug connector housing is the end that is received firstly in the counter-connector upon mating.

In an embodiment, the free end of the flexible arm protrudes through a top opening in the plug connector housing. In other words, the free end of the flexible arm is arranged exterior to the plug connector housing. This enables a user to easily operate the flexible arm if necessary. For example, the user may flex the flexible arm directly and manually without the plug connector housing being in the way. For example, the user may flex the flexible arm to unlock the plug connector housing from the counter-connector.

In a further embodiment, the flexible leg extends from its first end to its free end in a direction corresponding to the mating direction. In other words, the flexible leg extends toward the connection end of the plug connector housing when the secondary locking device is received in the plug connector.

In a preferred embodiment, the flexible leg extends in a direction opposite to the direction in which the flexible arm extends when the secondary locking device is received in the plug connector.

In an embodiment of the connector system according to the invention, when the flexible arm and the flexible leg are in a rest condition or when the flexible arm and the flexible leg are in a flexed condition, the blocking device and the abutment device are configured to block the secondary locking device from moving from an un-lock to the lock position. The abutment device and the blocking device engage each other and provide the blocking.

This is advantageous as it allows a user to only push the secondary locking device in the mating direction for mating the plug connector with the counter-connector. With a rest condition is meant a condition wherein there is no flexing.

In an embodiment of the connector system according to the invention, when the flexible arm is in a rest condition and the flexible leg is in a flexed condition, the blocking device and the abutment device are configured to release the secondary locking device allowing it to move from an un-lock to the lock position and from moving it from the lock to an un-lock position. When the flexible leg is in a flexed condition and the flexible arm is in a rest condition, the abutment device is moved away in a sideward direction from the blocking device and an engagement between the abutment device and the blocking device is not possible. This releases the secondary locking device and allows it to move with respect to the plug connector housing.

The invention further relates to a connector assembly. The connector assembly comprises a connector system according to the invention and further comprises the counter-connector. The connector assembly therefore comprises the plug connector, the secondary locking device and a counter-connector. The counter-connector is configured to at least partly receive the plug connector. The plug connector is configured to at least partly receive movably the secondary locking device.

In an embodiment of the connector assembly according to the invention, the counter-connector comprises a counter-connector housing having at least one side wall. The at least one side wall comprises a primary opening for receiving the primary locking protrusion and a secondary opening for receiving the secondary locking protrusion. This is advantageous as now only one side of the counter-connector is arranged with means for providing the primary- and the secondary locking function. Preferably, the counter-connector is free from protrusions that provide a primary and/or secondary locking function. This is advantageous as it allows a more compact and robust connector assembly.

In a further embodiment, the primary opening and the secondary opening are separated openings.

In an alternative embodiment, the primary opening and the secondary opening are formed as one opening.

In an embodiment of the connector assembly according to the invention, the primary opening is slot shaped and extends perpendicular to the mating direction (A). The secondary opening is slot shaped and extends parallel to the mating direction (A). In an alternative, the secondary opening extends perpendicular to the mating direction (A) and the primary opening extends parallel to the mating direction (A).

In an embodiment of the connector assembly according to the invention, the first side wall of the counter-connector housing comprises at least one elongated rib that cooperates with corresponding guides arranged in the plug connector housing. As the counter-connector is free from protrusions for providing primary and secondary locking functions, the counter-connector may be provided with the ribs. These ribs are advantageous as they provide a scoop proof functionality, making the assembly more robust while being compact.

In an embodiment, at the connection end of the plug connector housing, interfaces are arranged to interface with the counter-connector. Preferably, the diameters of these interfaces, which are shaped as openings, have a dimension smaller than 1.0 mm, preferably smaller than 0.5 mm. Preferably, the length of the plug connector housing is smaller than 5 cm, preferably smaller than 3 cm.

In an embodiment of the connector system according to the invention, the flexible leg of the secondary locking device is a first flexible leg and the secondary locking device comprises a second flexible leg. The flexible arm of the plug connector housing is provided between the first flexible leg and the second flexible leg. This has as advantage that a more robust connector system is provided as a push force applied on the secondary locking device may be evenly distributed over the first and second flexible legs. In other words a more symmetrical force distribution may be applied minimizing the risk that a moment force occurs which may break a flexible leg.

In a further embodiment, the secondary locking device comprises a reinforcement bridge provided between and integral with the first flexible leg and the second flexible leg. The free ends of the flexible legs are connected with each other, minimizing the risk of breaking the flexible legs when a force is applied on the secondary locking device. In a further embodiment, the reinforcement bridge comprises a sloping ramp surface for bending the flexible legs inward when the sloping ramp surface engages the blocking device. The reinforcement bridge further comprises a blocking surface for engaging the blocking device for the blocking between the secondary locking device and the plug connector. This has as advantage that a more compact and robust electrical connector system may be provided. The reinforcement bridge makes the secondary locking device more robust while at the same time providing the blocking functionality.

In an alternative embodiment each flexible leg comprises at its free end an abutment device wherein the abutment device comprises at a first end a blocking surface for engaging the blocking device and at a second end a sloping ramp surface for bending the flexible legs when the sloping ramp surface engages the blocking device, wherein the sloping ramp surface are defined by recesses in the flexible leg. Instead of a single sloping ramp surface, two separate sloping ramp surfaces are provided on the secondary locking device. Each flexible leg comprises such a sloping ramp surface. Each sloping ramp surface cooperates respectively with a first protruding blocking device and a second protruding blocking device disposed on the flexible arm. The protruding blocking devices protrude sideward from the flexible arm.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

Other characteristics and advantages of the invention shall appear upon reading the detailed description and the appended drawings, in which.

DETAILED DESCRIPTION OF THE INVENTION

Figure 1A:
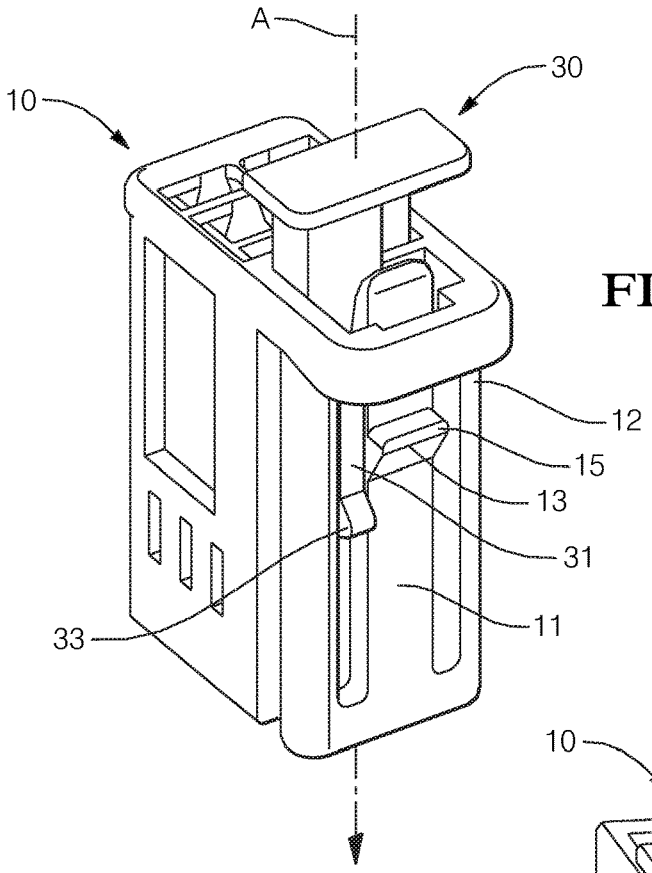
FIG. 1*a* shows a perspective view of a connector system according to a first embodiment comprising a plug connector and a secondary locking device.
Figure 1B:
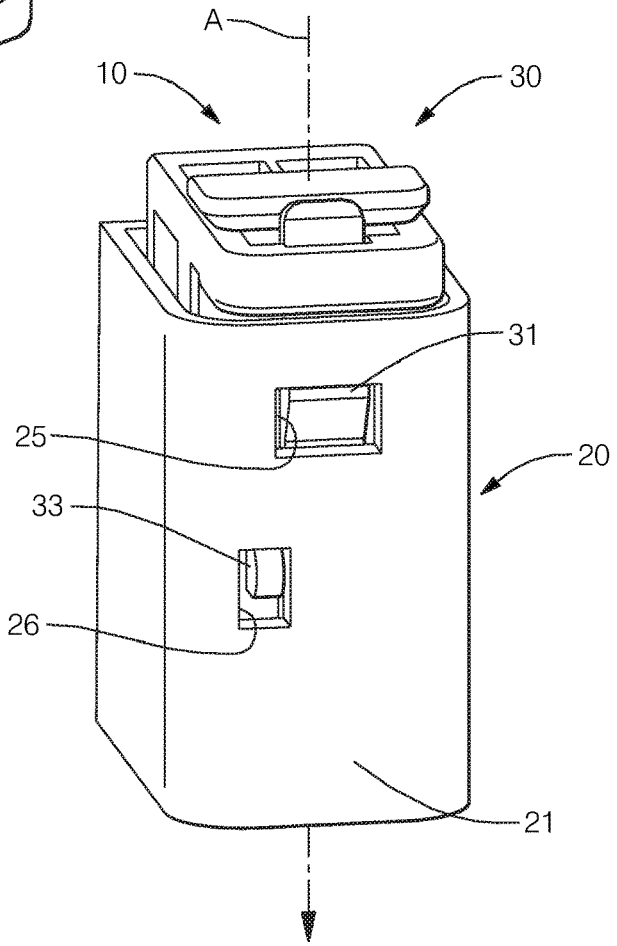
FIG. 1*b* shows a perspective view of a connector assembly comprising a plug connector, secondary locking device and a counter-connector.

FIG. 1*a* shows a connector system according to a first embodiment of the invention. The connector system comprises of a plug connector 10 and a secondary locking device 30. Here, the plug connector 10 is a 180° plug connector. However, 90° plug connectors or plug connectors with other angles are also suitable embodiments. The plug connector 10 can be mated to a counter-connector 20 shown in FIG. 1*b*. In FIG. 1*b* a connector assembly is shown comprised of the connector system and the counter-connector in a mated position. The plug connector 10 comprises two rows 16*a*, 16*b* of terminal cavities for receiving terminals (not shown).

The secondary locking device 30 is movably arranged relative to the plug connector housing 12 between an un-lock and a lock position. In the lock position the secondary locking device 30 provides a secondary locking with the counter-connector 20. In FIG. 1*a* the secondary locking device 30 is shown in an un-lock position. The plug connector comprises also a plug connector housing 12 that preferably is rectangular boxed shaped.

The plug connector housing 12 comprises an elongated chamber along the mating direction A, for at least partly receiving the secondary locking device 30. Here, the elongated chamber is a through hole. The secondary locking device 30 is movable in the elongated chamber, e.g. by means of cooperating guiding ribs and guiding grooves respectively arranged in the secondary locking device 30 and the plug connector housing 12. The plug connector housing 12 has four side walls a connection end and a first end. The four side walls are defined on the one hand by the height of the box, along the mating direction A and on the other hand by a length or width of the box, perpendicular to the mating direction A.

A flexible arm 11 is formed in a side wall of the plug connector housing 12. Preferably, this side wall is formed in a side wall defined by the height and the width. The flexible arm 11 is arranged with primary locking protrusion 13. The primary locking protrusion 13 is configured to provide a primary locking function when the plug connector 10 is in the mated position with a corresponding counter-connector 20 as shown in FIG. 1*b*. Preferably, the flexible arm 11 extends from its first end to its free end 41 opposite to the mating direction A. In other words, its free end 41 is faced away from a connection end of the plug connector and its first end is near this connection end.

The primary locking protrusion 13 comprises a nub 15 which is configured to cooperate with a primary opening 25 in the counter-connector 20 as shown in FIG. 1*b*. Here, the nub 15 is received in the primary opening 25 and thereby provides the primary locking function.

The secondary locking device 30 is arranged between an end of the at least one row of terminal cavities 16*a*. 16*b* and the flexible arm 11. The secondary locking device 30 has a flexible leg 31 with a secondary locking protrusion 33. The secondary locking protrusion 33 is configured to provide a secondary locking function when the plug connector 10 is in the mated position with the corresponding counter-connector 20.

Preferably, the flexible leg 31 extends from its first end to its free end in the mating direction A. In other words, its free end is faced towards the connection end of the plug connector and its first end is faced away from the connector end.

The secondary locking protrusion 33 is configured to cooperate with a secondary opening 26 in the counter-connector 20 as shown in FIG. 1*b*. Here, the secondary locking protrusion 33 is received in the secondary opening 26 and thereby provides the secondary locking function. It is advantageous that the primary and the secondary openings 25, 26 are arranged in a same sidewall 21 of the counter-connector 20.

The flexible arm 11 comprises a blocking device 14 configured to block the secondary locking device 30 from moving from the un-lock to the lock position when the plug connector 10 is in an unmated position with the counter-connector 20. The blocking device 14 is arranged on an inwardly facing side of the flexible arm 11 and the nub 15 is arranged on an opposing outwardly facing side of the flexible arm 11. The flexible leg 31 of the secondary locking device 30 comprises an abutment device 34 configured to engage with the blocking device 14 for the blocking. The secondary locking protrusion 33 is arranged on an outwardly facing side of the flexible leg 31 and the abutment device 34 is arranged on an opposing inwardly facing side of the flexible leg 31.

Figure 3A:
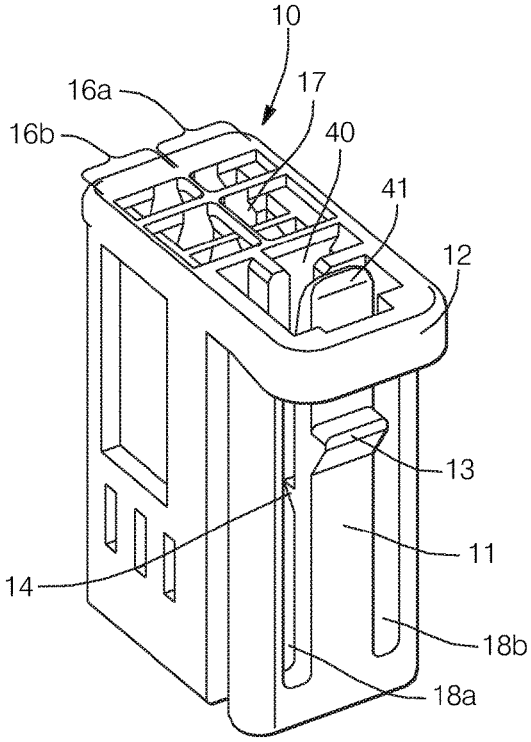
FIG. 3*a* shows a perspective view of a plug connector.

As shown in FIG. 3*a*, the plug connector housing 12 comprises an elongated first slot 18*a* that is elongated along the mating direction A. The elongated first slot 18*a* is arranged in a side wall of the plug connector housing 12. The secondary locking protrusion 33 are configured to protrude outwardly through the elongated first slot 18*a*. Preferably, the side wall in which the elongated first slot 18*a* is formed is the same side wall in which the flexible arm 11 is formed. More preferably, the elongated first slot 18*a* is arranged adjacent to the flexible arm 11 of the plug connector housing 12 and defines a first edge of the flexible arm 11.

The plug connector housing 12 comprises an elongated second slot 18*b* elongated along the mating direction A. The elongated second slot is arranged in a side wall which is the same as in which the flexible arm 11 is formed. The elongated second slot is adjacent to the flexible arm 11 and defines a second edge of the flexible arm 11.

Figure 2:
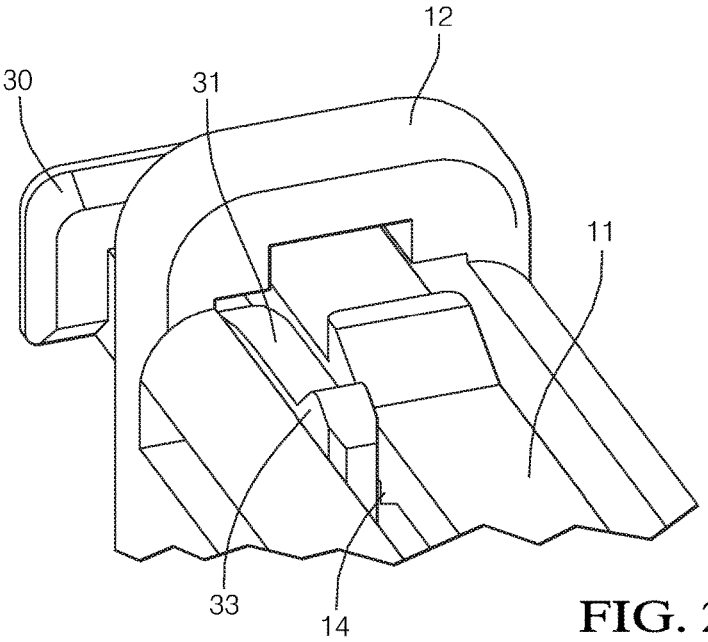
FIG. 2 shows a perspective side view of a plug connector and a secondary locking device.

In other words, the flexible arm 11 is arranged between the elongated first and second slots 18*a*, 18*b* and the flexible arm is at least partly defined by the elongated first and second slots 18*a*. 18*b*. When the flexible arm 11 and the flexible leg 31 are in a rest condition, the blocking device 14 and the abutment device 34 are configured to block the secondary locking device 30 from moving from an un-lock to the lock position. This is shown in FIG. 1*a* and FIG. 2.

When the plug connector 10 is moving from an unmated to the mated position, the flexible leg 31 and the flexible arm 11 are configured to be flexed from a rest condition to a flexed condition by a sidewall 21 of the counter-connector 20. In other words, the flexible leg 31 and the flexible arm 11 are configured to be flexed inwardly by a force applied by a sidewall 21 of the counter-connector 20 which acts on the primary and secondary locking protrusion 13, 33. For this purpose, the primary locking protrusion 13 and the secondary locking protrusion 33 comprise a sloped ramp surface arranged such that the flexible arm and flexible leg respectively bend inwards when the primary and secondary locking protrusions 13, 33 engage the side wall 21 of the counter-connector 20.

Preferably, the side wall 21 comprises on a receiving end of the counter-connector a collar 22. This collar 22 actuates the flexible leg 31 and the flexible arm 11. When the flexible arm 11 and the flexible leg 31 are in a flexed condition, the blocking device 14 and the abutment device 34 are configured to block the secondary locking device 30 from moving from an un-lock to the lock position. When the flexible arm 11 and the flexible leg 31 are both flexed, the abutment device 34 and blocking device 14 are engaging each other and cooperate for the blocking. When the flexible arm 11 is in a rest condition and the flexible leg 31 is in a flexed condition, the blocking device 14 and the abutment device 34 are configured to release the secondary locking device 30 allowing it to move from an un-lock to the lock position. When the flexible arm 11 is in a rest condition and the flexible 31 leg is in a flexed condition, the blocking device 14 and the abutment device 34 are configured to allow the secondary locking device 30 from moving from the lock to an un-lock position.

Figure 3B:
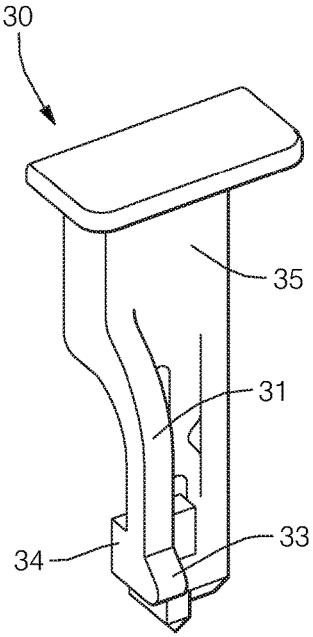
FIG. 3*b* shows a perspective view of secondary locking device.

As shown in FIG. 3*b* the secondary locking device 30 comprises of a flexible leg 31 that has curved part and a straight part. The straight part is parallel to the mating direction. Due to the curved part the straight part, on which the secondary locking protrusion 33 is arranged, is offset with respect to a base part 35 of the secondary locking device 30. The base part 35 is used to guide the secondary locking device 30 in the plug connector housing 12 and preferably is rigid. Having the flexible leg 31 partly offset with respect to the base part 35 allows the secondary locking protrusion 33 to protrude through the plug connector housing 12 and engage with the counter-connector 20.

Figure 4A:
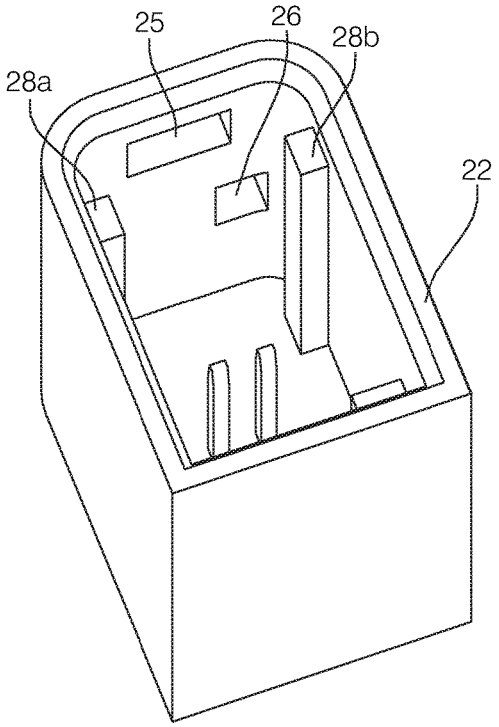
FIG. 4*a* shows a perspective view of a counter-connector.
Figure 4B:
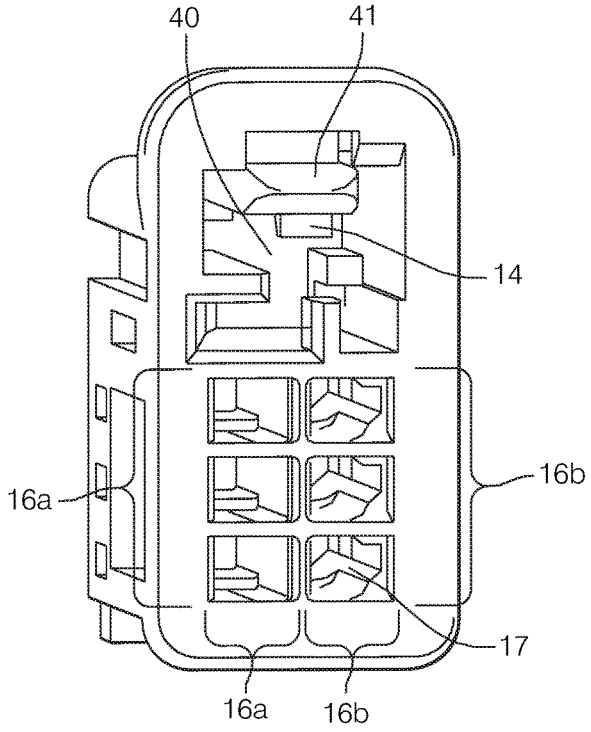
FIG. 4*b* shows a perspective top view of a plug connector.
Figure 5A:
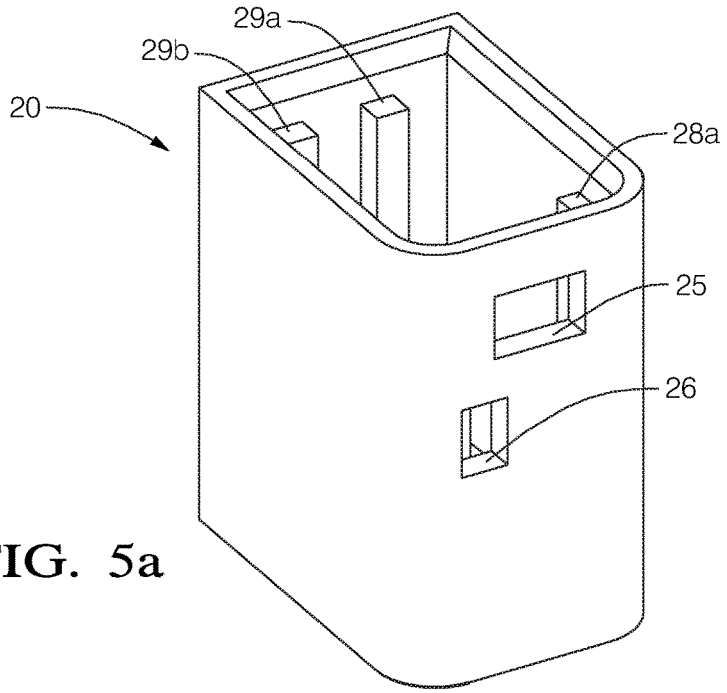
FIG. 5 a shows a perspective view of a counter-connector according to an alternative embodiment.
FIG. 5*b* shows a perspective view of a counter-connector according to an alternative embodiment.
Figure 5B:
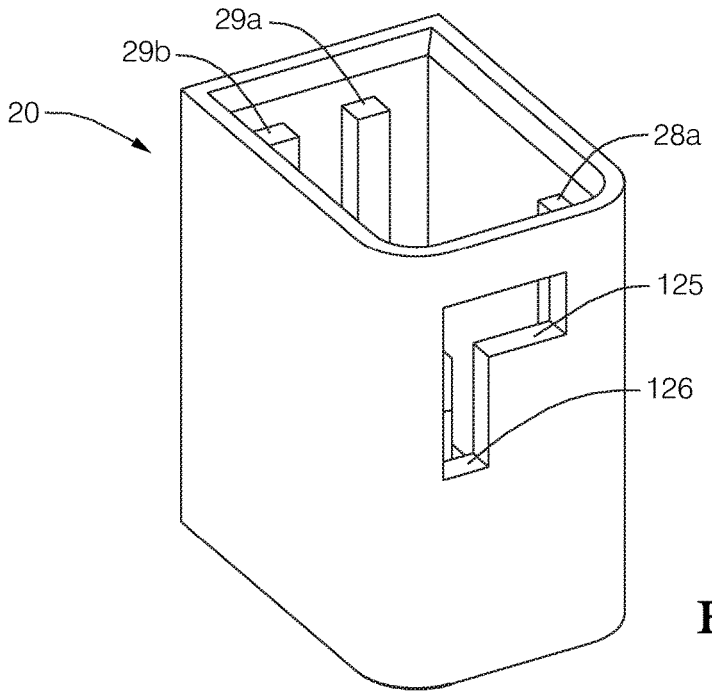

As shown in FIG. 4*a* and FIG. 4*b*, a side wall of the counter-connector housing comprises a first elongated rib 28*a* facing inwards that cooperates with a corresponding guide 19*a* arranged in the plug connector housing 12 facing outwards. Further elongated ribs 28*b*, 29*a*, 29*b* are shown in FIGS. 5*a*, 5*b* that cooperate with corresponding guides (not all shown) in the plug connector housing 12. As the counter-connector 12 is free from protrusions for providing primary and secondary locking functions, the counter-connector 12 may be provided with the ribs 28*a*, 28*b*, 29*a*, 29*b*. These ribs 28*a*, 28*b*, 29*a*, 29*b* are advantageous as they provide a scoop proof functionality, making the assembly more robust while being compact.

As shown in FIG. 5*a*, the counter-connector comprises a primary opening 25 for receiving the primary locking protrusion 13 and a secondary opening 26 for receiving the secondary locking protrusion 33. In this embodiment, the primary opening 25 and the secondary opening 26 are separated openings.

As shown in FIG. 5*b*, in another embodiment, the primary opening 125 and the secondary opening 126 are formed as one opening. The primary opening 25 is preferably slot shaped, wherein the slot shape extends perpendicular to the mating direction A and the secondary opening 26 is slot shaped, wherein the slot shape extends parallel to the mating direction A. Alternatively, but not shown here, the secondary opening 25 is extending perpendicular to the mating direction A and the primary opening 26 is extending parallel to the mating direction A.

A second embodiment and a third embodiment are described below. Similar features in one embodiment correspond with similar features in another embodiment.

Figure 6B:
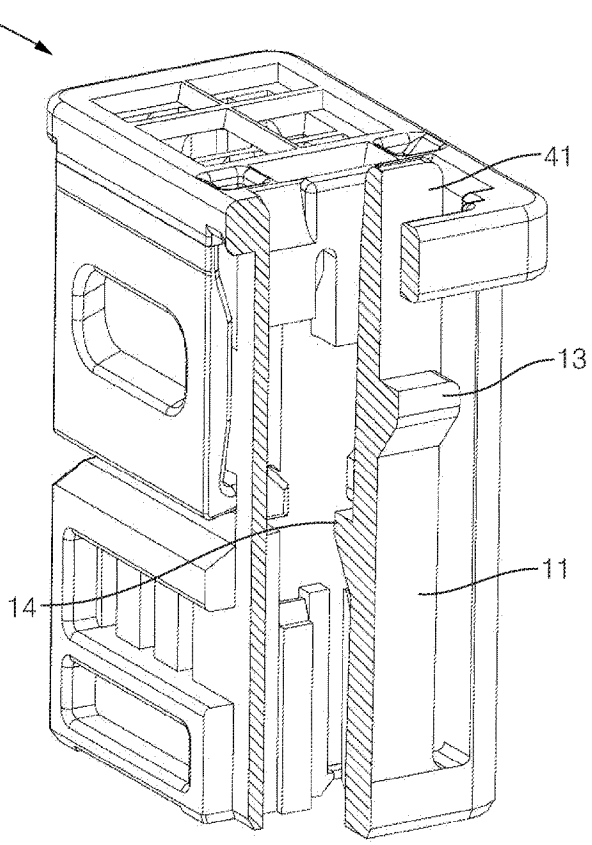
FIG. 6*b* shows a perspective view of a plug connector for a connector system according to the second embodiment.
Figure 6A:
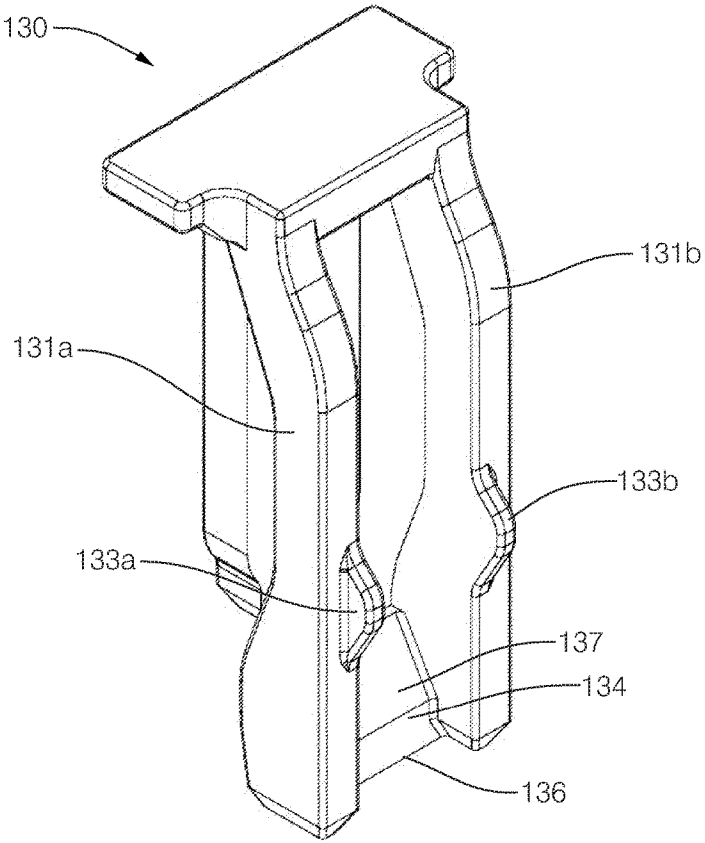
FIG. 6*a* shows a perspective view of a secondary locking device for a connector system according to a second embodiment.

In a second embodiment of the invention the electrical connector system 110 according to the invention, the secondary locking device 130 comprises a first flexible leg 131*a* and a secondary flexible leg 131*b* as shown in FIG. 6*a*. The flexible arm 11 of the plug connector housing 12 is provided between the first flexible leg 131*a* and the second flexible leg 131*b*. This is advantageous as two legs 131*a*. 131*b* provide a more robust secondary locking when a user is pushing on the secondary locking device 130. Having the flexible arm 11 between the legs 131*a*, 131*b* allows for a symmetrical and evenly distributed force transfer from the secondary locking device to the plug connector. This minimizes a risk that a moment force occurs while pushing the secondary locking device.

Also shown in FIG. 6*a* is that each leg 131*a*, 131*b* comprises respectively a first secondary locking protrusion 133*a* and a second secondary locking protrusion 133*b*. Preferably, the first and second secondary locking protrusion 133*a*, 133*b* are slideable along the primary locking protrusion 13 of the flexible arm 11. Or in other words, the primary locking protrusion 13 is slideably disposed between the first and second secondary locking protrusion 133*a*, 133*b*.

Shown in FIG. 6*b* is the plug connector 110 according to the second embodiment. This plug connector 110 is similar to the plug connector 10 according to the first embodiment and comprises the flexible arm 11, the blocking device 14 and the primary locking protrusion 13. The plug connector housing comprises an elongated chamber 140 along the mating direction A, for at least partly receiving the secondary locking device 130 according to the second embodiment. The elongated chamber 140 is configured to receive the secondary locking device 130 according to the second embodiment Here, the elongated chamber is a through hole. The secondary locking device 130 is movable in the elongated chamber 140, e.g. by means of cooperating guiding ribs and guiding grooves respectively arranged in the secondary locking device 130 and the plug connector housing. The secondary locking device 130 comprises a reinforcement bridge 134 provided between and integral with the first flexible leg 131*a* and the second flexible leg 131*b*. The reinforcement bridge 134 comprises a sloping ramp surface 137 for bending the flexible legs 131*a*, 131*b* when the sloping ramp surface 137 engages the blocking device 14 of the flexible arm 11 of the plug connector 110. The reinforcement bridge 134 also comprises a blocking surface 136 for engaging the blocking device 14 for the blocking.

Figure 7B:
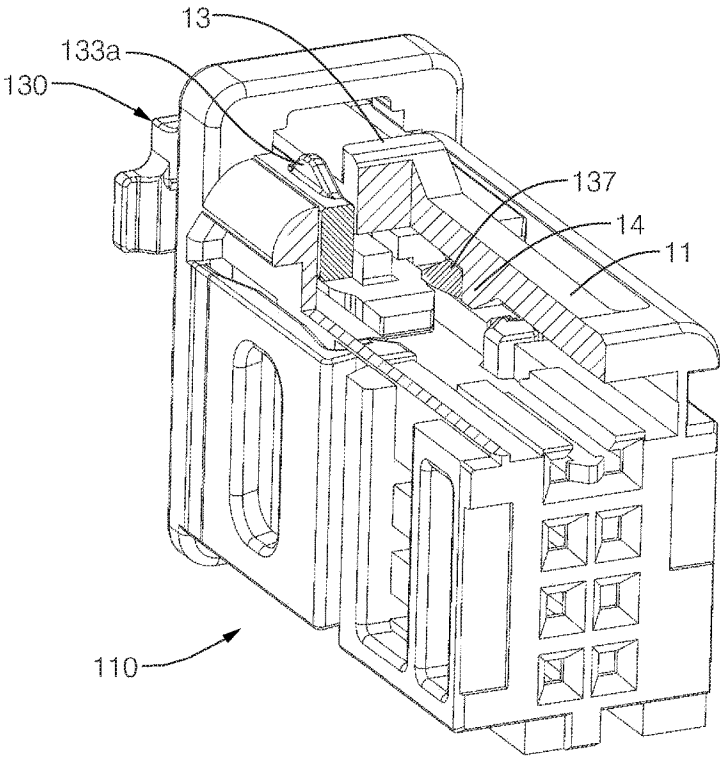
FIG. 7*b* shows another perspective view of the connector system according to the second embodiment wherein the secondary locking device is in the un-lock position.
Figure 7A:
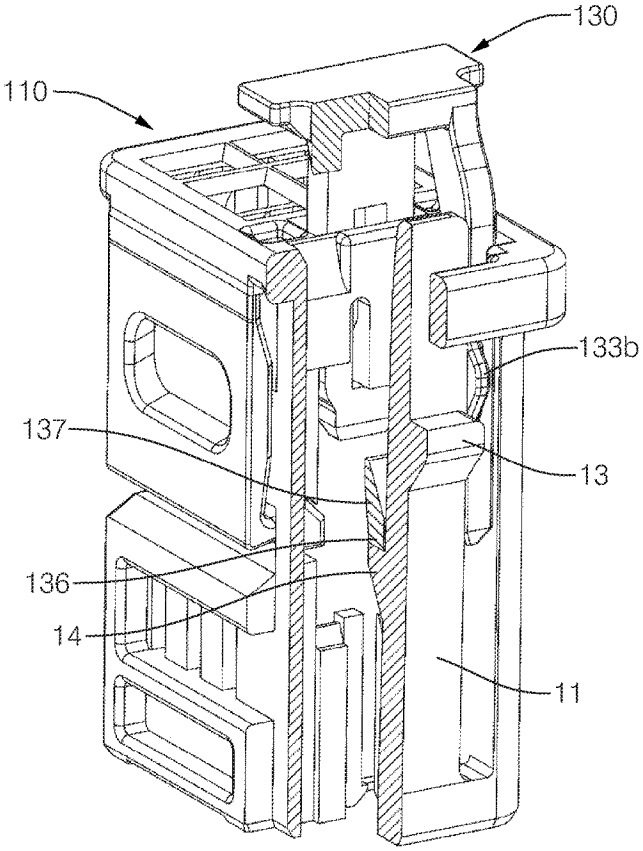
FIG. 7*a* shows a perspective view of the connector system according to the second embodiment wherein the secondary locking device is in an un-lock position.

FIG. 7*a* and FIG. 7*b* show the electrical connector system according to the second embodiment comprising the secondary locking device 130 and the plug connector 110 in an un-lock position. In the un-lock position, the secondary locking protrusion 130 is blocked by the blocking means 14 of the flexible arm 11 of the plug connector 110. This blocking occurs due to the blocking surface 136 that engages the blocking means 14.

Figure 8B:
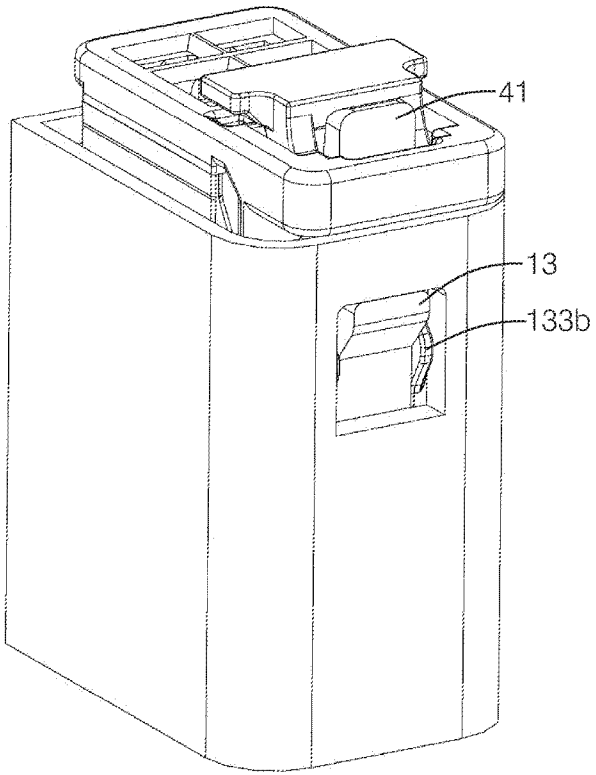
FIG. 8*b* shows another perspective view of the connector system according to the second embodiment wherein the plug connector is in a mated position with a counter-connector and the secondary locking device is in the lock position.
Figure 8A:
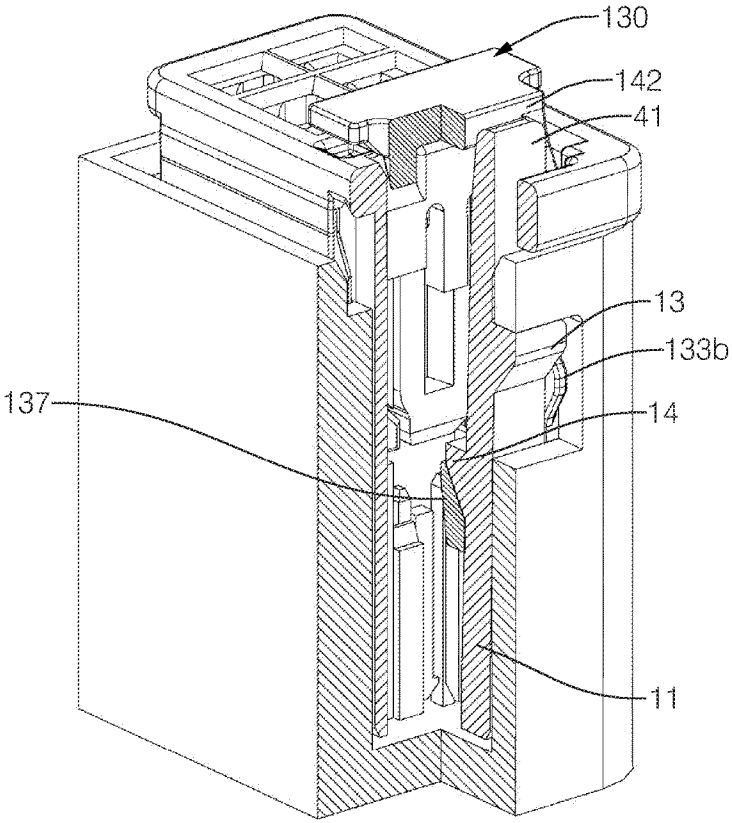
FIG. 8*a* shows a perspective view of the connector system according to the second embodiment wherein the plug connector is in a mated position with a counter-connector and the secondary locking device is in the lock position.

FIG. 8*a* and FIG. 8*b* show the plug connector 110 being in a mated position with the counter-connector 120. The plug connector 110 is pushed towards the mated condition by pushing on the secondary locking protrusion 130. During the movement, a wall of the counter-connector 120 asserts an inward force on the first and second secondary locking protrusion 133*a*. 133*b*. This results in an inward bending of the first and second legs 131*a*. 131*b*, which releases the blocking between the blocking surface and the blocking device 14. This results in that the secondary locking protrusion 130 can be pushed further into the lock position and the plug connector 110 can be pushed into the mated position with the counter-connector 120. In the mated position, as shown in FIG. 8*b*, the free end 41 of the flexible arm 11 is blocked to bend inwards. The primary locking protrusion 13 lock the plug connector 110 with respect to the counter-connector 120. The first and second secondary locking protrusion 133*a*, 133*b* provide a secondary lock between the plug connector and the counter-connector 120.

Figure 9B:
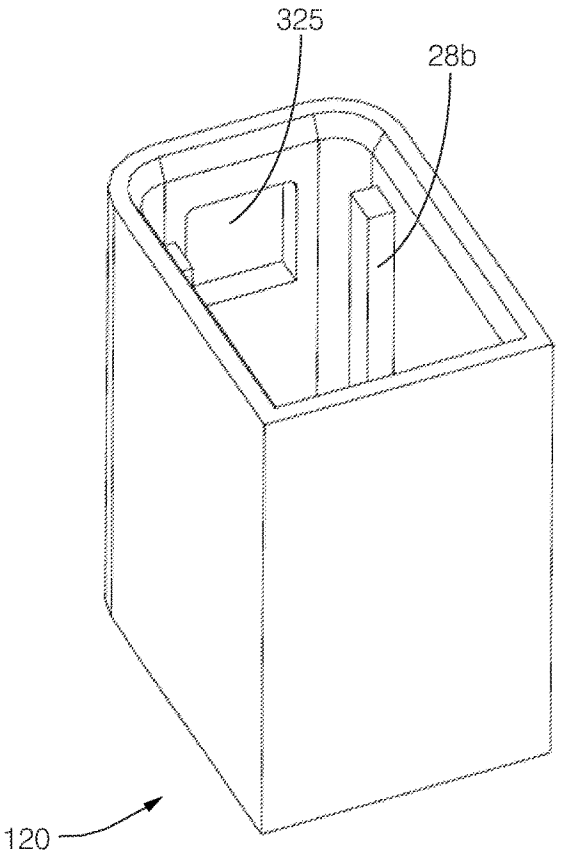
FIG. 9*b* shows a counter-connector suitable to be mated to the connector system according to the second embodiment.
Figure 9A:
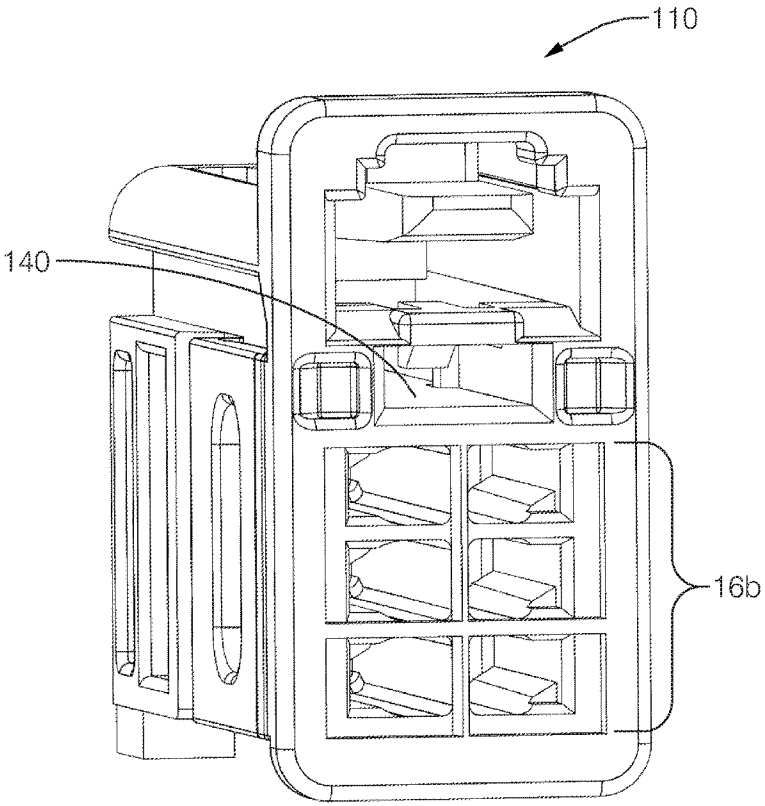
FIG. 9*a* shows a perspective view of the plug connector for a connector system according to the second embodiment.

FIG. 9*a* shows the elongated chamber 140 that is configured to receive the secondary locking device 130 in the plug connector 110. It is also shown that the secondary locking device 130 can be received between a row of terminal cavities 16*b* and the flexible arm 11.

FIG. 9*b* shows the counter-connector 120 having a first opening 225 and a second elongated rib 28*b*.

A third embodiment of the electrical connector system according to the invention, is similar to the second embodiment, however each flexible leg comprises at its free end an abutment device 234*a*, 234*b*, instead of the single sloping ramp surface 137 of the first embodiment. This is shown in FIG. 10*a*. The abutment device 234*a*, 243*b* comprises at a first end a blocking surface for engaging the blocking device 14 and at a second opposing end a sloping ramp surface for bending the flexible legs 231*a*. 231*b* inwards. This bending results when the sloping ramp surface of each abutment device 234*a*, 234*b* engages the blocking device 14. The sloping ramp surfaces of each abutment device are defined by recesses in the flexible leg.

Figure 10B:
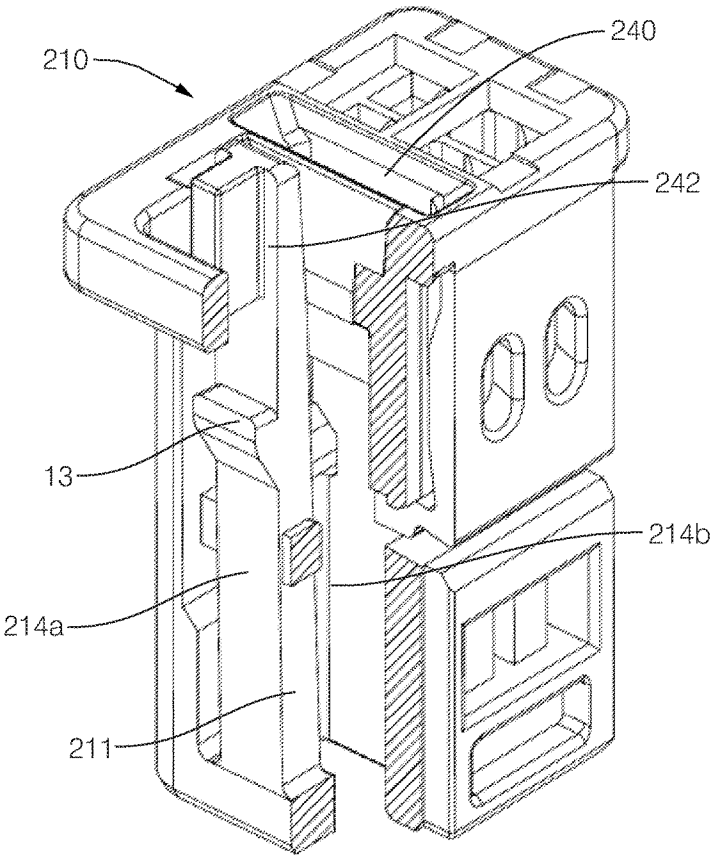
FIG. 10*b* shows a perspective view of a plug connector for a connector system according to the third embodiment.
Figure 10A:
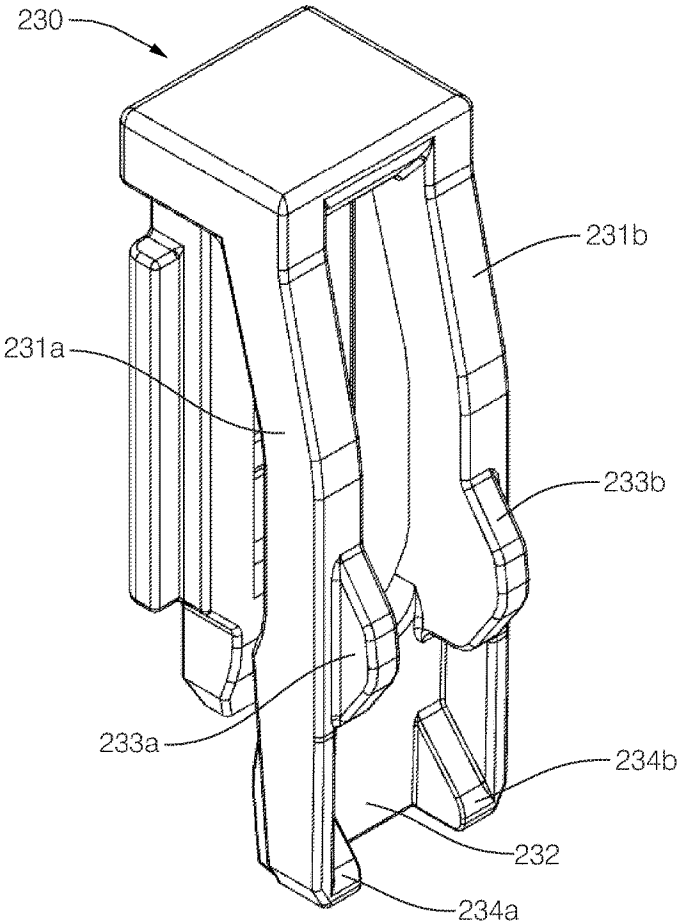
FIG. 10*a* shows a perspective view of a secondary locking device for a connector system according to a third embodiment.

As shown in FIG. 10*b*, the plug connector 210 according to the third embodiment comprises a flexible arm 211 having at one side a protruding first blocking device 214*a* and at an opposing side a protruding second blocking device 214*b*. The first blocking device 214*a* and the second blocking device cooperate and engage respectively with the sloping ramp surface of the abutment device 23*a*, 234*b* of each flexible leg 231*a*, 231*b*. Further shown in FIG. 10*b* is an arm bias 242 that is provided on the free end of the flexible arm 211. This arm bias 242 abuts with a collar of the plug connector.

Figure 11A:
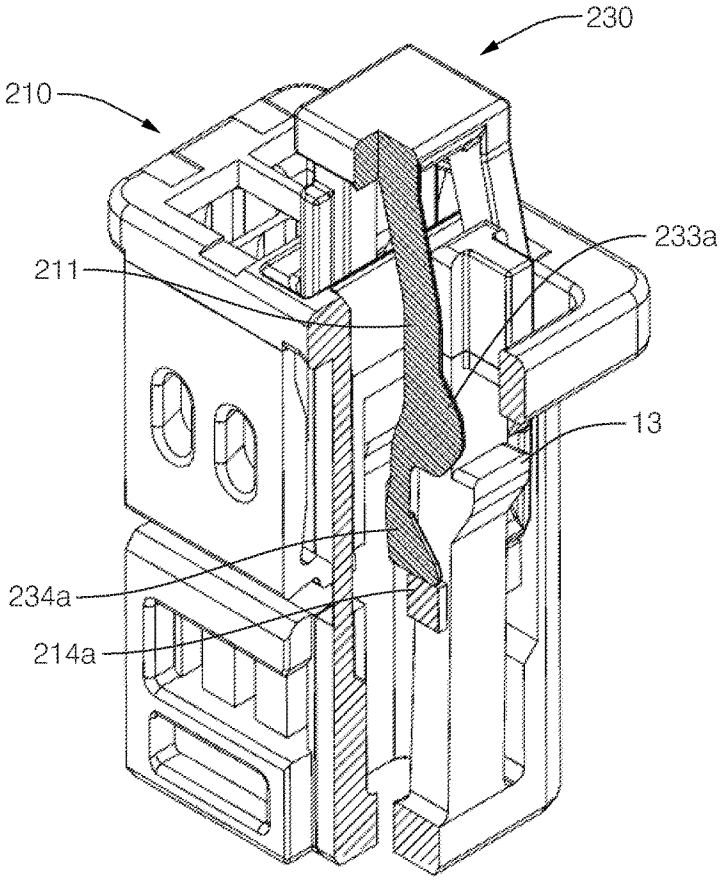
FIG. 11*a* shows a perspective view of the connector system according to the third embodiment wherein the secondary locking device is in an un-lock position.
Figure 11B:
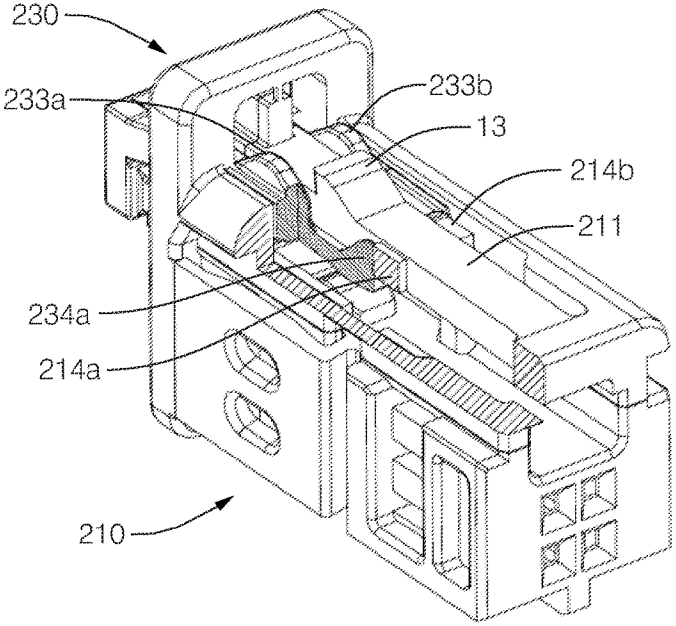
FIG. 11*b* shows another perspective view of the connector system according to the third embodiment wherein the secondary locking device is in the un-lock position.

FIG. 11*a* and FIG. 11*b* show the plug connector 210 and the secondary locking device 230 of the third embodiment in an un-lock position. The plug connector 110 and secondary locking device 230 function similar like the secondary embodiment, however the abutment device 234*a*, 234*b* comprises two separated sloping ramp surfaces. The flexible arm 211 is movably arranged between these separated sloping ramp surfaces. The separated sloping ramp surfaces cooperate and engage with the first and second blocking devices 214*a*, 214*b* which protrude from the sides of the flexible arm 211.

Figure 12B:
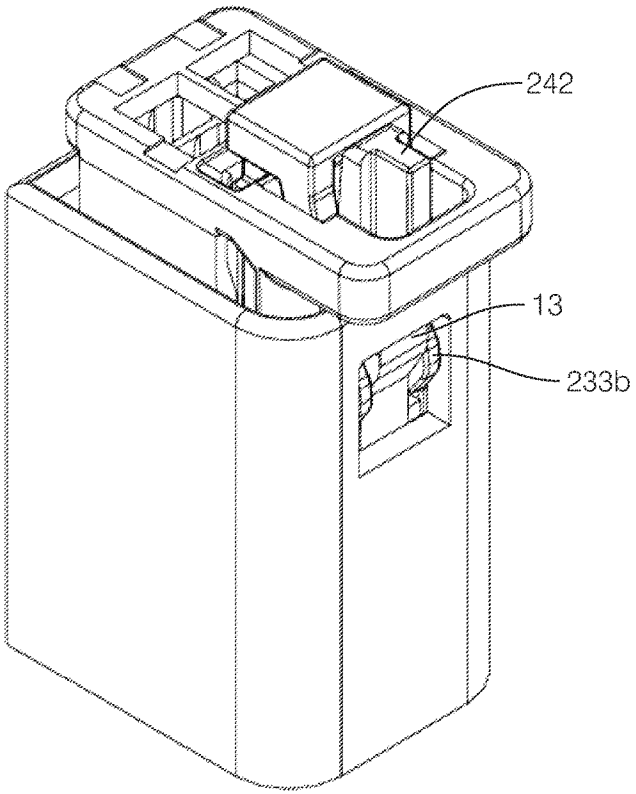
FIG. 12*b* shows another perspective view of the connector system according to the third embodiment wherein the plug connector is in a mated position with a counter-connector and the secondary locking device is in the lock position.
Figure 12A:
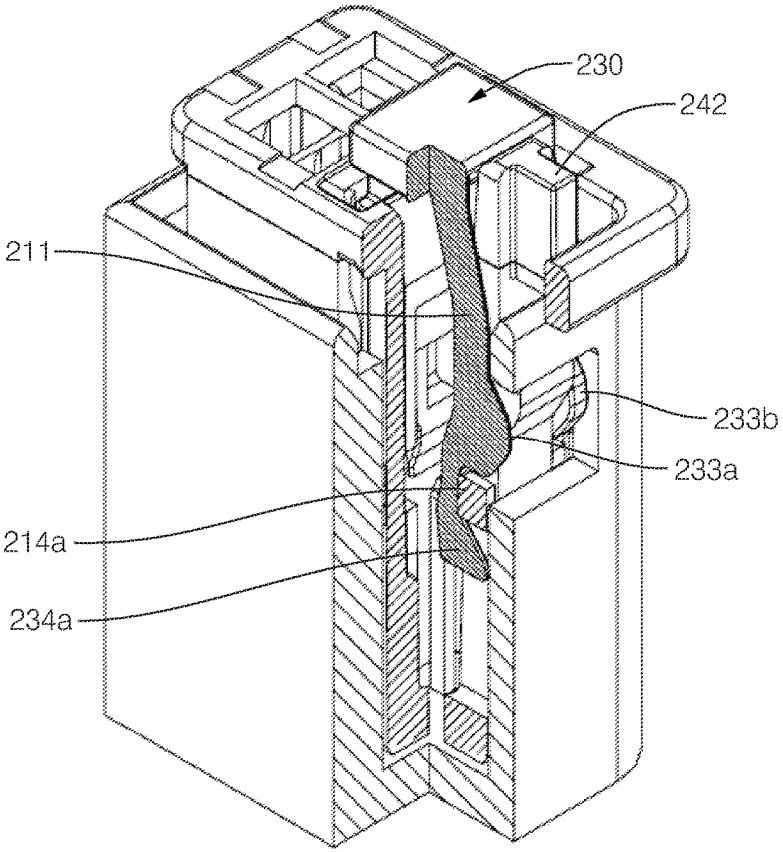
FIG. 12*a* shows a perspective view of the connector system according to the third embodiment wherein the plug connector is in a mated position with a counter-connector and the secondary locking device is in the lock position.

FIG. 12*a* and FIG. 12*b* show the electrical connector system in a mated position with the counter-connector 220.

Figure 13B:
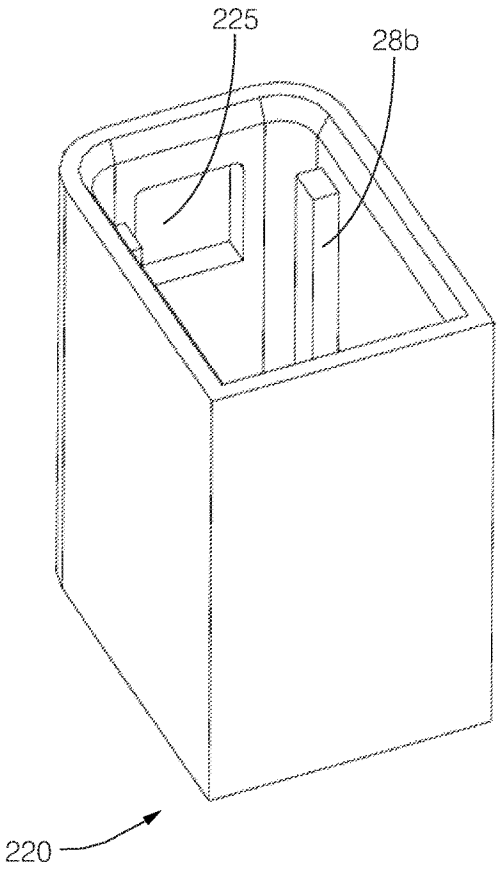
FIG. 13*b* shows a counter-connector suitable to be mated to the connector system according to the third embodiment.
Figure 13A:
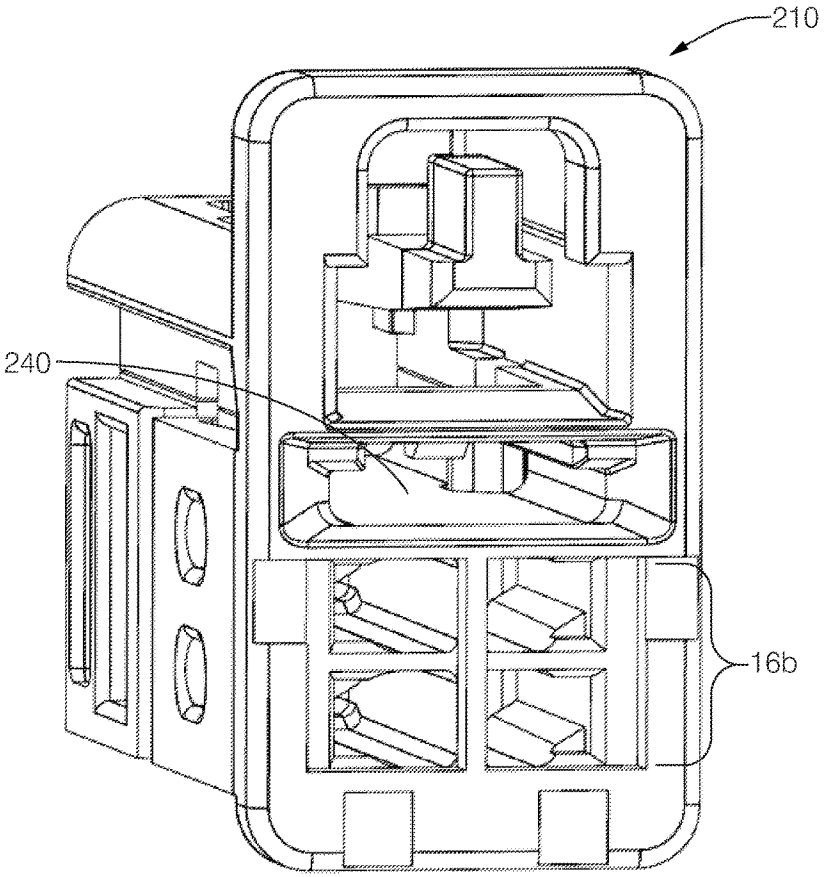
FIG. 13*a* shows a perspective view of the plug connector for a connector system according to the third embodiment.

FIG. 13*a* shows the elongated chamber 240 for receiving the secondary locking device 230 according to the third embodiment.

FIG. 13*b* shows the counter-connector 220 according to the third embodiment.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

In the following claims, the terms "including" and "in which" are used as the plain-English equivalents of the respective terms "comprising" and "wherein." Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements. Further, the limitations of the following claims are not written in means-plus-function format and are not intended to be interpreted based on 35 USC § 112(f), unless and until such claim limitations expressly use the phrase "means for" followed by a statement of function void of further structure.

LIST OF REFERENCES

10 Plug connector
11 Flexible arm
12 Plug connector housing
13 Primary locking protrusion
14 Blocking device
15 Nub
16*a* First row of terminal cavities
16*b* Second row of terminal cavities
17 Terminal cavity
18*a* Elongated first slot
18*b* Elongated second slot
19*a* First elongated guide
19*b* Second elongated guide
20 Counter-connector
21 Counter-connector sidewall
22 Collar
25, 125 First opening
26, 126 Second opening
28*a* First elongated rib
28*b* Second elongated rib
29*a* Third elongated rib
29*b* Fourth elongated rib
30 Secondary locking device
31 Flexible leg
33 Secondary locking protrusion
34 Abutment device
35 Base part
40 Elongated chamber
41 Free end of the flexible arm

The invention claimed is:

1. An electrical connector system, comprising:

a plug connector, including:

at least one row of terminal cavities for receiving terminals, and a plug connector housing having:

a flexible arm arranged in a side wall of the plug connector housing, a primary locking protrusion extending from the flexible arm configured to provide a primary locking function when the plug connector is in a mated position with a corresponding counter-connector, and a secondary locking device arranged between an end of the at least one row of terminal cavities and the flexible arm, the secondary locking device being arranged movable relative to the plug connector housing between an un-lock position and a lock position, said secondary locking device having a flexible leg with a secondary locking protrusion extending from the flexible leg configured to provide a secondary locking function when the plug connector is in the mated position with the corresponding counter-connector, wherein the flexible arm of the plug connector housing comprises a blocking device configured to block the secondary locking device from moving from the un-lock position to the lock position when the plug connector is in an unmated position with the counter-connector, wherein the flexible leg of the secondary locking device comprises an abutment device configured to engage with the blocking device.

2. The electrical connector system according to claim 1, wherein the primary locking protrusion and the secondary locking protrusion are configured to cooperate with a primary opening and a secondary opening in the counter-connector respectively, and wherein the primary opening and the secondary opening are arranged in a corresponding side wall of the counter-connector.

3. The electrical connector system according to claim 1, wherein the secondary locking protrusion is arranged on an outwardly facing side of the flexible leg and the abutment device is arranged on an opposing inwardly facing side of the flexible leg.

4. The electrical connector system according to claim 1, wherein the blocking device is arranged on an inwardly facing side of the flexible arm and the primary locking protrusion is arranged on an opposing outwardly facing side of the flexible arm.

5. The electrical connector system according to claim 4, wherein the blocking device protrudes inwardly and sideward towards the flexible leg of the secondary locking device.

6. The electrical connector system according to claim 5, wherein the abutment device protrudes inwardly and sideward towards the flexible arm of the plug connector housing.

7. The electrical connector system according to claim 1, wherein the plug connector housing comprises an elongated first slot arranged in the side wall of the plug connector housing and extending in a mating direction, wherein the secondary locking protrusion is configured to protrude outwardly through the elongated first slot.

8. The electrical connector system according to claim 7, wherein the elongated first slot is arranged adjacent to the flexible arm of the plug connector housing.

9. The electrical connector system according to claim 8, wherein the plug connector housing comprises an elongated second slot adjacent to the flexible arm and extending in the mating direction, wherein the flexible arm is arranged between the first slot and the second slot.

10. The electrical connector system according to claim 7, wherein the flexible arm extends from a first end to a free end opposite to the mating direction and wherein the flexible leg extends from the first end to the free end in the mating direction.

11. The electrical connector system according to claim 1, wherein the blocking device and the abutment device are configured to release the secondary locking device, thereby allowing the secondary locking device to move from the un-lock position to the lock position and thereby allowing the secondary locking device to move from the lock position to the un-lock position when the flexible arm is in a rest condition and the flexible leg is in a flexed condition.

12. The electrical connector system according to claim 1, wherein the blocking device and the abutment device are configured to block the secondary locking device from moving from the un-lock position to the lock position when the flexible arm and the flexible leg are in a rest condition or when the flexible arm and the flexible leg are in a flexed condition.

13. The electrical connector system according to claim 1, wherein the flexible leg of the secondary locking device is a first flexible leg and the secondary locking device comprises a second flexible leg and wherein the flexible arm of the plug connector housing is provided between the first flexible leg and the second flexible leg.

14. The electrical connector system according to claim 13, wherein the secondary locking device comprises a reinforcement bridge provided between and integral with the first flexible leg and the second flexible leg.

15. The electrical connector system according to claim 14, wherein the reinforcement bridge comprises a sloping ramp surface configured to bend the first flexible leg and the second flexible leg when the sloping ramp surface engages the blocking device and comprises a blocking surface for engaging the blocking device for said blocking.

16. The electrical connector system according to claim 15, wherein each flexible leg comprises the abutment device at the free end, wherein the abutment device comprises the blocking surface at a first end for engaging the blocking device and the sloping ramp surface at a second end for bending the flexible legs when the sloping ramp surface engages the blocking device, and wherein the sloping ramp surface are defined by recesses in the flexible leg.

17. The electrical connector system according to claim 16, wherein the blocking device of the flexible arm comprises two protruding blocking devices each configured to cooperate with the abutment device.

18. The electrical connector system according to claim 1, further comprising the counter-connector configured to at least partly receive the plug connector and the secondary locking device.

19. The electrical connector system according to claim 18, wherein the counter-connector comprises a counter-connector housing having at least one side wall, wherein the at least one side wall comprises:

a primary opening for receiving the primary locking protrusion, and a secondary opening for receiving the secondary locking protrusion.

20. The electrical connector system according to claim 19, wherein the primary opening and the secondary opening are separated from one another.

21. The electrical connector system according to claim 19, wherein the primary opening and the secondary opening are formed as a single opening.

22. The electrical connector system according to claim 19, wherein the primary opening is slot shaped and extends perpendicular to a mating direction and wherein the secondary opening is slot shaped and extends parallel to the mating direction.

23. The electrical connector system according to claim 19, wherein the secondary opening extends perpendicular to the mating direction and the primary opening extends parallel to the mating direction.

* * * * *